United States Patent [19]

Medlin

[11] Patent Number: 4,630,929

[45] Date of Patent: Dec. 23, 1986

[54] APPARATUS FOR PRODUCING PATCHING MATERIAL FOR FILLING POTHOLES IN PAVED SURFACES

[76] Inventor: Michael A. Medlin, 125 Conestoga Rd., Madison, Miss. 39110

[21] Appl. No.: 770,617

[22] Filed: Aug. 29, 1985

Related U.S. Application Data

[63] Continuation-in-part of Ser. No. 659,133, May 9, 1984, abandoned.

[51] Int. Cl.[4] ..... B28C 5/06

[52] U.S. Cl. ..... 366/10; 239/654; 239/662

[58] Field of Search ..... 366/3, 5, 10, 11, 150; 404/111, 107, 108; 239/654, 662, 434; 406/47, 48, 49

[56] References Cited

U.S. PATENT DOCUMENTS

| | | | |
|---|---|---|---|
| 1,477,741 | 12/1923 | Wotier | 239/654 |
| 1,500,385 | 7/1924 | Halliburton | 366/5 |
| 3,931,959 | 1/1976 | Truman | 366/10 |
| 4,089,441 | 5/1978 | Cole | 239/654 |
| 4,264,212 | 4/1981 | Tookey | 366/3 |
| 4,394,975 | 7/1983 | Bare | 239/654 |
| 4,511,284 | 4/1985 | Sterner | 239/654 |

*Primary Examiner*—Robert W. Jenkins

[57] ABSTRACT

An apparatus is disclosed for producing patching material for filling potholes and the like in paved surfaces which includes a hopper for receiving a quantity of pulverulent material, a tubular discharge mechanism in the bottom of the hopper which employs the Venturi effect created by air under pressure to draw the material into the tube and discharge it through an opening and means for controlling the flow of material into the discharge mechanism. A nozzle is connected to the discharge opening and has means adjacent the orifice thereof for introducing a quantity of asphalt emulsion into the stream of material for mixing therewith prior to discharge from the orifice into the pothole or the like to be filled.

6 Claims, 8 Drawing Figures

FIG. 6
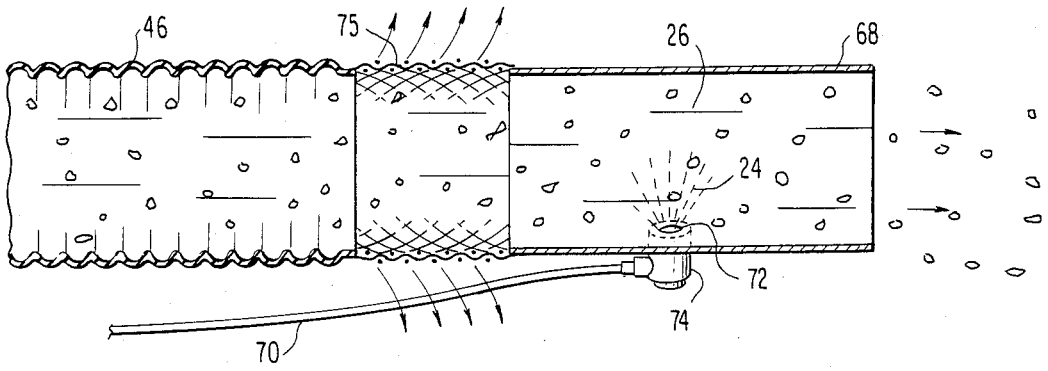
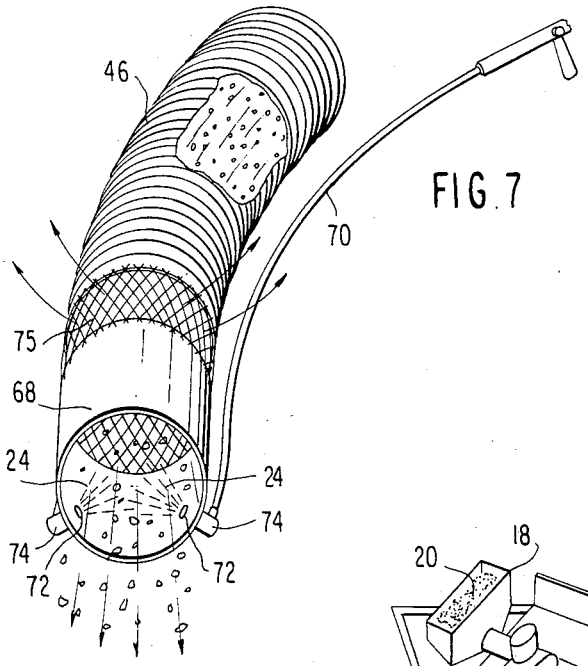
FIG. 7
FIG. 8
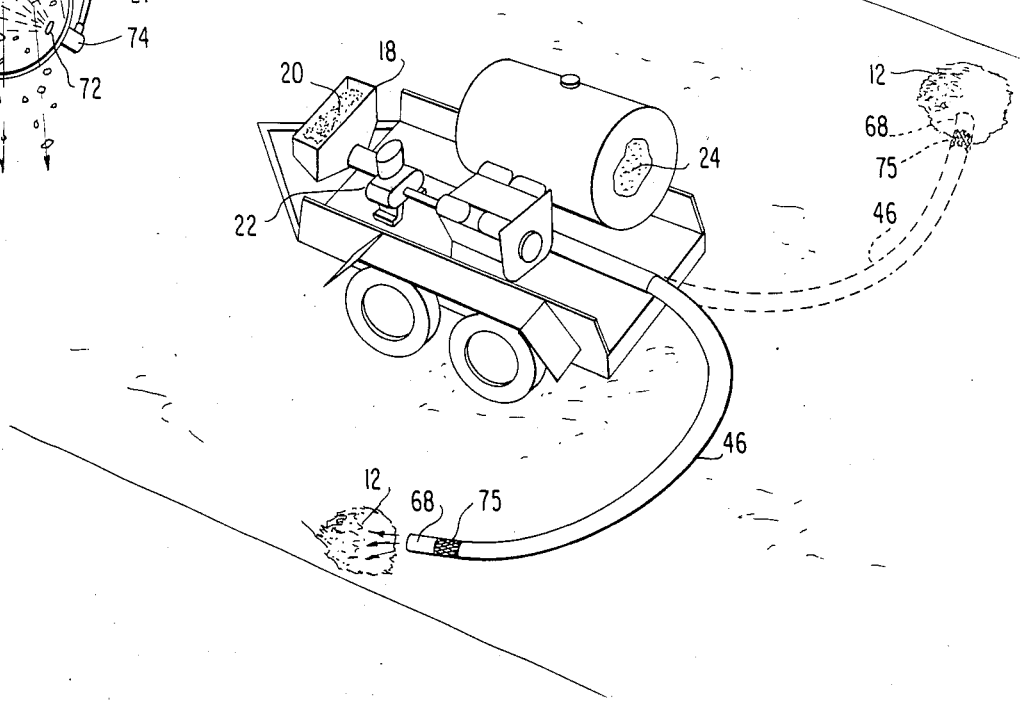

APPARATUS FOR PRODUCING PATCHING MATERIAL FOR FILLING POTHOLES IN PAVED SURFACES

BACKGROUND OF THE INVENTION

This application is a continuation-in-part of U.S. Application Ser. No. 06/659,133 bearing the same title and filed May 9, 1984 by the same inventor, now abandoned.

This invention relates to a patching apparatus and more particularly to an apparatus which delivers a controlled flow of pulverulent material from a hopper containing a supply source to a nozzle wherein it is mixed with an asphalt emulsion prior to discharge for use as a filling material for potholes and the like in paved surfaces.

Applicant is unaware of any device in the prior art which is constructed as, or operates in the same manner as the patching device of the invention disclosed in this application. Devices for preparing roadway paving or patching material of the type which consists of pulverulent or crushed materials, such as stone, coated with bituminous material, such as an asphalt emulsion, are not new. A typical example of such a prior art device is shown in U.S. Pat. No. 1,854,100 wherein crushed stone or the like is delivered to a large storage receptacle from a hopper with the aid of air under pressure. As the stone enters the receptacle it is sprayed with liquid bitumen and cooled by an air stream prior to storage. This type of apparatus is suitable for preparing large batches of asphalt which is then trucked to the point of use and hand shoveled into the area to be patched or dumped into a machine for paving large areas of roadway.

Other known devices use complex mechanisms such as hydraulically driven rotating discs, augers and the like to deliver the crushed material to a stream of air under pressure which transports it to a location for mixing with liquid bituminous material. Such devices require large power plants to supply electricity to run the hydraulic or pneumatic mechanisms and large platforms mounted on trailers, truck bodies, or the like.

In contrast to the foregoing described prior art devices, the subject invention is a compact unit which employs the Venturi principle rather than a complex mechanical mechanism to draw the crushed material into an air stream that in turn transports the material to a hand-held nozzle where it is mixed with a liquid bituminous emulsion. The asphalt mixture thus produced can be blown into a pothole or the like for patching purposes.

It is therefore the primary object of the present invention to provide a superior apparatus for producing patching material for filling potholes in paved surfaces.

It is another object of the present invention to provide an apparatus of the subject type which employs no moving parts to deliver pulverulent material to transport means for that material, such as air under pressure.

It is yet another object of the present invention to provide an apparatus which employs simple yet effective means for controlling the quantity of pulverulent material being delivered to a hand held nozzle for mixing therein with a controlled quantity of asphalt emulsion prior to discharge therefrom to the location of intended use.

It is a further object of the present invention to provide an apparatus of the subject type which is compact, relatively lightweight in construction and easily transportable.

It is a still further object of the present invention to provide an apparatus of the subject type that has the aforedescribed advantageous objects which is also easy to maintain and use and can be made and sold at a reasonable cost.

Other objects and advantages of the invention will appear in the following description of the preferred embodiment of the invention as shown on the accompanying drawings.

IN THE DRAWINGS

FIG. 6 is a sectional view of the exit end of flexible hose 46 taken along its centerline.

FIG. 7 is a perspective view of the exit end of flexible hose 46 shown from in front of the exit aperture of that hose.

FIG. 8 is a perspective view of the subject apparatus mounted on a vehicle for its operation.

DESCRIPTION OF PREFERRED EMBODIMENT

Figure 1:
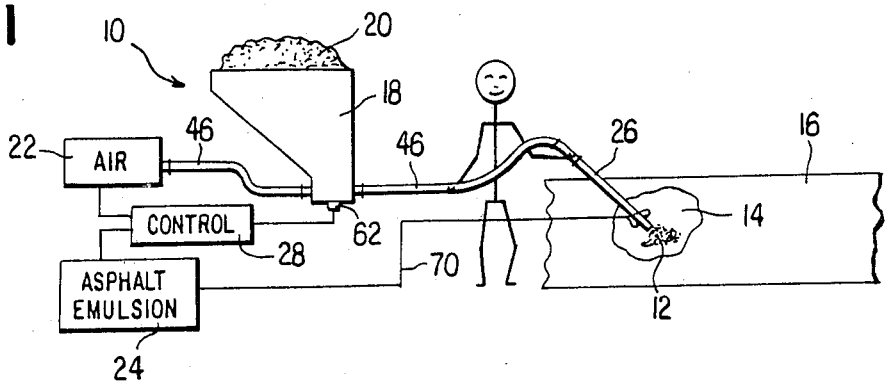
FIG. 1 is a schematic illustration of the apparatus for producing patching material connected to sources of air under pressure and asphalt emulsion that includes a control for that apparatus.

Referring now to the drawings where like characters of reference indicate like elements in each of the several views, FIG. 1 shows a system 10 employing the apparatus of the present invention for producing asphalt-type patching material 12 for filling potholes and the like 14 in paved surfaces 16. The apparatus generally includes a hopper 18 for holding a quantity of crushed or pulverulent material 20 and a source 22 of air under high pressure. A source 24 of liquid, asphalt emulsion is also provided which is delivered to a hand held mixing and discharge nozzle 26. A control 28 regulates the various elements of the system 10.

More specifically, the hopper 18 has an upper chamber 30 into which the crushed or pulverulent material 20 such as rock, gravel, stone or baked clay is deposited. The upper chamber 30 has a slanted lower wall 32 to funnel the material 20 to a lower chamber 34 where it is caused to be withdrawn therefrom by air under pressure which air is combined with the material 20 in a mixing device 36 as will now be more fully described. The mixing device 36 includes a hollow, cylindrical shaped tube 38 which extends across the lower chamber 34 and through side walls 39 thereof.

The mixing tube 38 is connected at its inlet end 40 to the source of high pressure air 22 such as an air compressor by means of conduit 42 and at its outlet end 44 to the nozzle 26 by means of a flexible hose 46. The tube 38 has a longitudinally extending aperture 48 through a wall thereof facing the upper chamber 30 and in communication therewith. The lower chamber 34 may also be provided with slanted guide plates 50 which extend from the sides of the lower chamber to a point adjacent the aperture 48 to continuously direct the material 20 to the vicinity of the aperture 48. In order to draw the material 20 through the aperture 48 into the tube 38 and transport it out the outlet end 44 and through the hose 46 and nozzle 26 beyond, applicant utilizes the well known Venturi effect created by the change in the properties of the air flow in the vicinity of the aperture 48.

Figure 2:
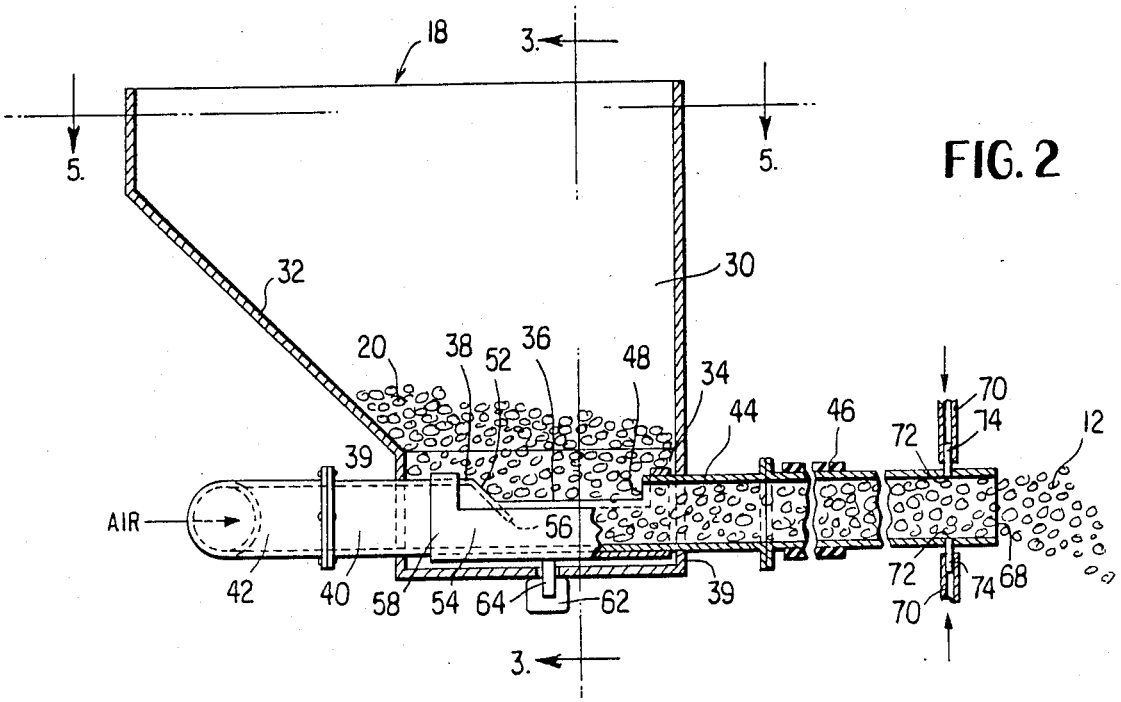
FIG. 2 is a side elevational view of one side of the apparatus in partial cross-section showing the control valve open.
Figure 3:
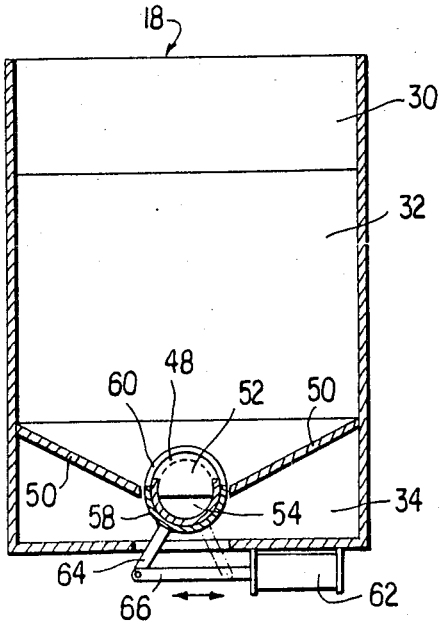
FIG. 3 is an end elevational view in cross-section taken along the lines 3—3 of FIG. 2.
Figure 4:
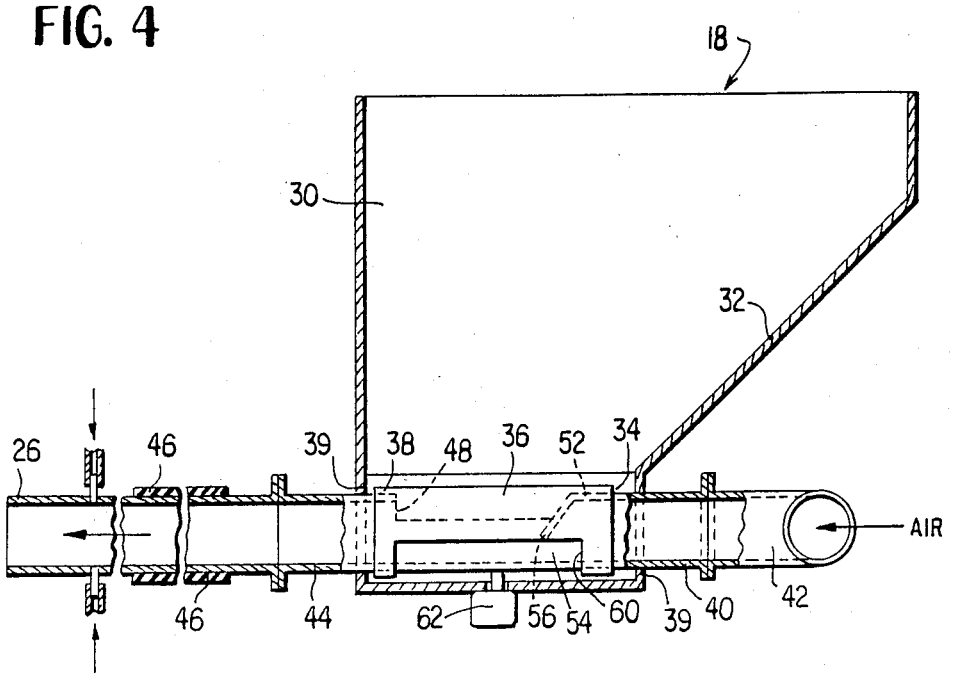
FIG. 4 is a side elevational view of the other side of the apparatus in partial cross-section showing the control valve closed.
Figure 5:
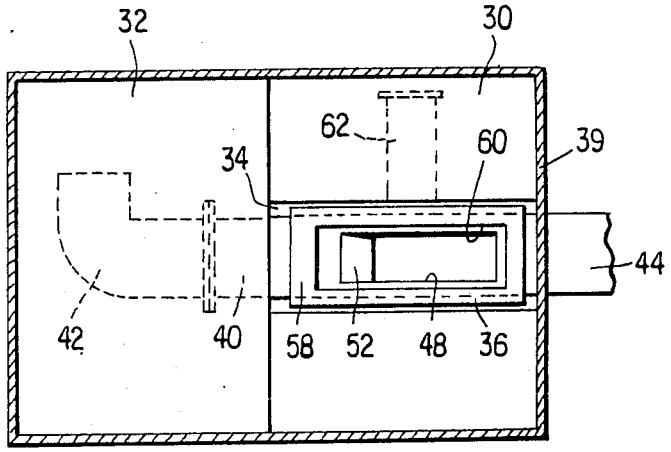
FIG. 5 is a top view in cross-section taken along the lines 5—5 of FIG. 2.

The Venturi effect aforementioned is created by securing a plate member 52 at an angle with respect to the centerline of the tube 38 across the upper portion of the tube 38 at the end of the aperture 48 closest the inlet end 40 as can best be seen in FIGS. 2 and 3. During operation, with the aperture 48 unobstructed or open, air under pressure from source 22 enters the inlet end 40 and engages the plate member 52 whereupon the direction of a portion thereof is changed and forced through the passageway 54 defined by the wall of the tube 38 and the end 56 of the plate member 52. As the air transverses passageway 54, the velocity thereof increases and the pressure thereof decreases according to the Venturi principle as it exits the passageway 54 beneath the aperture 48. This decrease in pressure adjacent aperture 48 causes the material 20 to be drawn from the lower chamber 34 into the air stream and forced through outlet end 44 where it is transported thereby through hose 46 to nozzle 26 as aforementioned.

In order to control the quantity of material 20 being drawn into tube 38 through aperture 48 and subsequently out nozzle 26, a hollow, cylindrical-shaped closure member 58 is rotatable mounted on tube 38 and is concentric therewith. The closure member 58 has an aperture 60 extending longitudinally thereof and of a shape similar to and slightly larger than aperture 48 in tube 38. An activator 62 secured beneath lower chamber 34 is connected to closure member 58 by means of an arm 64 connected to reciprocating rod 66. The activator 62 can be for example, a conventional hydraulic or pneumatic controlled piston (not shown) connected to rod 66 which, when in its extreme extended position, (to left as viewed in FIG. 3) rotates apertures 48, 60 into registry thus permitting the maximum amount of material 20 to be drawn into the air stream, and when in its extreme retracted position (to right as viewed in FIG. 3, see phantom lines) it rotates the side of the closure member 58 to cover the aperture 48 thus shutting off entrance of the material 20. Rotational movement of closure member 58 to positions intermediate the aforementioned extremes can be used to control the precise quantity of material 20 discharged at nozzle 26.

The nozzle 26 as previously mentioned is connected to outlet end 44 by means of a flexible hose 46 and serves as a conduit to deliver the material 20 carried by the air stream to a point adjacent the end 68 of the nozzle where it is mixed with a liquid asphalt emulsion. Because the force of the air stream moving through flexible hose 46 may become sufficiently great to blow the discharge material 20 out of a pothole, I have found that inclusion of cylindrical wire mesh screen 75 approximately 4 inches from the exit end of hose 46 improves the performance of the apparatus. Such a wire mesh screen 75 (see FIGS. 6, 7 and 8) can be approximately 2 to 3 inches long and should have openings no larger than approximately 3/16 of an inch to prevent loss of the material 20 through screen 75 when part of the air stream is dissipated through screen 75 (see arrows in FIG. 6).

The asphalt emulsion 24 typically comprises asphalt, water and an emulsifier and is readily, commercially available. The asphalt emulsion 24 is fed in a hose 70 to two oppositely disposed discharge parts 72 adjacent the end 68 connected to tubes 74. The liquid asphalt emulsion 24 thus exits the ports 72 under pressure and mixes with a material 20 carried there past by the air stream. The particles of material 20 are thus substantially coated with the asphalt emulsion 24 prior to exiting end 68 and directed to the point of use such as a pothole 14. The control 28 is connected to activator 62 as well as the source of pressurized air 22 and source of asphalt emulsion 24 to insure the proper quantity and consistency of the resultant patching material 12.

Applicant has thus described in detail his novel and single apparatus for producing patching material for filling potholes and the like in paved surfaces. It being understood of course that numerous changes in details of construction, arrangement and operation may be effected without departing from the spirit of the invention, especially as defined in the appended claims.

What I claim is:

1. An apparatus for producing patching material for filling potholes in paved surfaces comprising:

(a) a hopper means for holding a quantity of pulverulent material, said means having an opening for receiving said marterial from a source and a transport tube means in the bottom of said hopper means, said tube means having an inlet opening connected to a source of air under pressure and an outlet opening connected to a discharge nozzle, said transport tube means also having an intake opening intermediate said inlet and outlet openings to receive said material into said transport tube means, and means adjacent said intake opening to cause said material to be drawn into said tube by said air flowing under pressure in through said intake opening and out through said outlet opening;

(b) means between said outlet opening and said discharge nozzle to dissipate part of the air stream so that said material will not be blown out of said pothole during filling; and (c) means adjacent said discharge nozzle for introducing an emulsion to combine with said material prior to its discharge from said nozzle into said pothole.

2. An apparatus as set forth in claim 1 further comprising means for controlling the flow of said material through said intake opening.

3. An apparatus as set forth in claim 2 wherein said controlling means consists of:

(a) a tubular member rotatably mounted over said transport tube means and having an aperture therethrough, and (b) means operatively connected to said tubular member for rotating said tubular member to bring said aperture into or out of registery with said intake opening in said transport tube means.

4. An apparatus as set forth in claim 1 wherein said means adjacent said intake opening to cause said material to be drawn into said transport tube means is a constriction means in said transport tube means upstream of said intake opening that causes the velocity of said air under pressure to be increased in the vicinity of said intake opening to create an area of lower pressure to draw said material into said transport tube means.

5. An apparatus as set forth in claim 4 wherein said construction means is a plate, secured in and extending partially across, said transport tube at an angle with respect to the ceterline of said transport tube.

6. An apparatus as set forth in claim 1 wherein said emulsion introducing means comprises two oppositely disposed apertures through a wall of said nozzle, each of said apertures being connected to a source of said emulsion.

* * * * *